US007786831B2

(12) United States Patent
Oh

(10) Patent No.: US 7,786,831 B2
(45) Date of Patent: Aug. 31, 2010

(54) MODULAR TERMINAL FOR MOLDED CASE CIRCUIT BREAKER AND MOLDED CASE CIRCUIT BREAKER HAVING THE SAME

(75) Inventor: Ki-Hwan Oh, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 451 days.

(21) Appl. No.: 11/752,661

(22) Filed: May 23, 2007

(65) Prior Publication Data

US 2008/0246566 A1 Oct. 9, 2008

(30) Foreign Application Priority Data

Apr. 3, 2007 (KR) ..... 10-2007-0032929

(51) Int. Cl.
*H01R 9/22* (2006.01)
*H01H 71/08* (2006.01)
*H01H 73/20* (2006.01)

(52) U.S. Cl. ..... 335/202; 200/293; 439/709; 439/712; 439/715; 439/717

(58) Field of Classification Search ..... 335/202; 439/709–717; 200/293
See application file for complete search history.

(56) References Cited

U.S. PATENT DOCUMENTS

| | | | | |
|---|---|---|---|---|
| 6,010,373 | A * | 1/2000 | Donahue | 439/717 |
| 6,045,402 | A | 4/2000 | Embo et al. | |
| 7,559,807 | B2 * | 7/2009 | Freimuth et al. | 439/717 |
| 7,701,313 | B2 | 4/2010 | Kim | |
| 2005/0255757 | A1 | 11/2005 | Takaya | |
| 2006/0131145 | A1 | 6/2006 | Suh | |
| 2008/0218297 | A1 | 9/2008 | Kim | |

FOREIGN PATENT DOCUMENTS

| | | |
|---|---|---|
| CN | 1219012 | 6/1999 |
| EP | 0626711 | 11/1994 |
| EP | 0717425 | 6/1996 |
| EP | 0996136 | 7/2001 |
| JP | 11-224583 | 8/1999 |
| JP | 11-339625 | 12/1999 |
| JP | 2002-199514 | 7/2002 |
| JP | 2002-237248 | 8/2002 |
| JP | 2005-322554 | 11/2005 |
| JP | 2007-213963 | 8/2007 |
| JP | 2008-29133 | 2/2008 |
| JP | 2008-226808 | 9/2008 |
| KR | 10-2006-0087344 | 8/2006 |
| KR | 20060087344 | 8/2006 |

OTHER PUBLICATIONS

English language Abstract of JP 11-224583.
English language Abstract of KR 10-2006-0087344.
U.S. Appl. No. 11/752,421 to Oh, which was filed on May 23, 2007.
English language Abstract of JP 2005-322554, Nov. 17, 2005.
English language Abstract of JP 11-339625, Dec. 10, 1999.
English language Abstract of JP 2007-213963, Aug. 23, 2007.
English language Abstract of KR 20060087344.

* cited by examiner

*Primary Examiner*—Ramon M Barrera
(74) *Attorney, Agent, or Firm*—Greenblum & Bernstein, P.L.C.

(57) ABSTRACT

A modular terminal for a molded case circuit breaker by which various types of terminals can be joined together and configuration and assembly are simplified, the modular terminal comprising a plurality of terminal bases each of which is provided for each phase, a terminal which is detachably supported at each terminal base, and a joint piece which connects a pair of the terminal bases adjacent to each other to form a terminal module.

6 Claims, 10 Drawing Sheets

MODULAR TERMINAL FOR MOLDED CASE CIRCUIT BREAKER AND MOLDED CASE CIRCUIT BREAKER HAVING THE SAME

RELATED APPLICATION

The present disclosure relates to subject matter contained in priority Korean Application No. 10-2007-0032929, filed on Apr. 3, 2007, which is herein expressly incorporated by reference in its entirety.

BACKGROUND OF THE INVENTION

1. Field of the Invention

The present invention relates to a molded case circuit breaker, and particularly, to a modular terminal for a molded case circuit breaker by which various types of terminals, such as standard type terminals, plug-in type terminals, or box type terminals, are replaceable or mountable in a module replacement manner by embodying the terminal portion of the molded case circuit breaker as a modular assembly structure, and a molded case circuit breaker having the modular terminal.

2. Background of the Invention

Here, a terminal denotes separate terminal equipment for connecting an external wire, which is connected to a terminal portion connected to a fixed contactor of a molded case circuit breaker to facilitate the connection between external wires of power source side or electric load side and the terminal.

In general, a molded case circuit breaker may have a terminal portion for connecting electric wires of power source and electric load sides to each of power source or electric load side terminals.

The molded case circuit breaker according to the related art has a detachable terminal portion other than a fixed terminal portion. Accordingly, when fabricating the molded case circuit breaker, the terminal portion is integrally assembled to a case for the molded case circuit breaker and thereby replacement of only the terminal portion is impossible. Therefore, the molded case circuit breaker according to the related art has a structure in which the change in only a type of terminal portion is impossible.

When desiring to change any type of terminal portion, among a standard type terminal, a plug-in type terminal and a box type terminal, into another type of terminal portion according to wiring environments of the power source side and the electric load side, the molded case circuit breaker according to the related art does not have a structure in which only a terminal portion can be provided to a user according to its type. As a result, the molded case circuit breaker itself should be replaced with a molded case circuit breaker with the desired type of terminal.

In order to solve this inconvenience in the related art, a common platform for all the types of terminals is formed at the terminal portion of the molded case circuit breaker, and an assembly of each type of terminal with a common connection structure corresponding to the common platform have been proposed.

However, when fabricating or installing the molded case circuit breaker of the related art, the terminal assemblies based upon each type of terminal should be assembled one by one according to each phase of the molded case circuit breaker, namely, R, S and T Alternating/Current 3-phases (called 3-poles) or R, S, T and N Alternating/Current 4-phase (called 4-poles).

Furthermore, it is also difficult for manufacturers of the molded case circuit breakers to manage, as separate components, the terminal assembly of each type of terminal with a size of several centimeters, for example, about 1 to 3 centimeters, and it is not easy to be provided to uses or installation operators.

SUMMARY OF THE INVENTION

Therefore, an aspect of the present invention is to provide a modular terminal for a molded case circuit breaker by which terminal modules can easily be assembled to a molded case circuit breaker by modularizing a plurality of terminal assemblies, thus to allow the installation and replacement of a terminal portion to be simplified and rapidly performed, and a molded case circuit breaker with the same.

Another aspect of the present invention is to provide a modular terminal for a molded case circuit breaker capable of joining various types of terminals into one terminal module, and a molded case circuit breaker with the same.

To achieve these and other advantages and in accordance with the purpose of the present invention, as embodied and broadly described herein, there is provided a modular terminal for a molded case circuit breaker comprising:

a plurality of terminal bases each of which is provided for each phase; a terminal which is detachably supported at each terminal base; and a joint piece which connects a pair of the terminal bases adjacent to each other to form a terminal module.

In another aspect of the present invention, there is provided a molded case circuit breaker comprising: a plurality of terminal bases each of which is provided for each phase; a terminal which is detachably supported at each terminal base; a joint piece which connects a pair of the terminal bases adjacent to each other to form a terminal module, wherein the plurality of terminal bases having the terminals mounted thereat are connected to each other so as to form the terminal module; and a case connected to the terminal module by the joint piece.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

Figure 1:
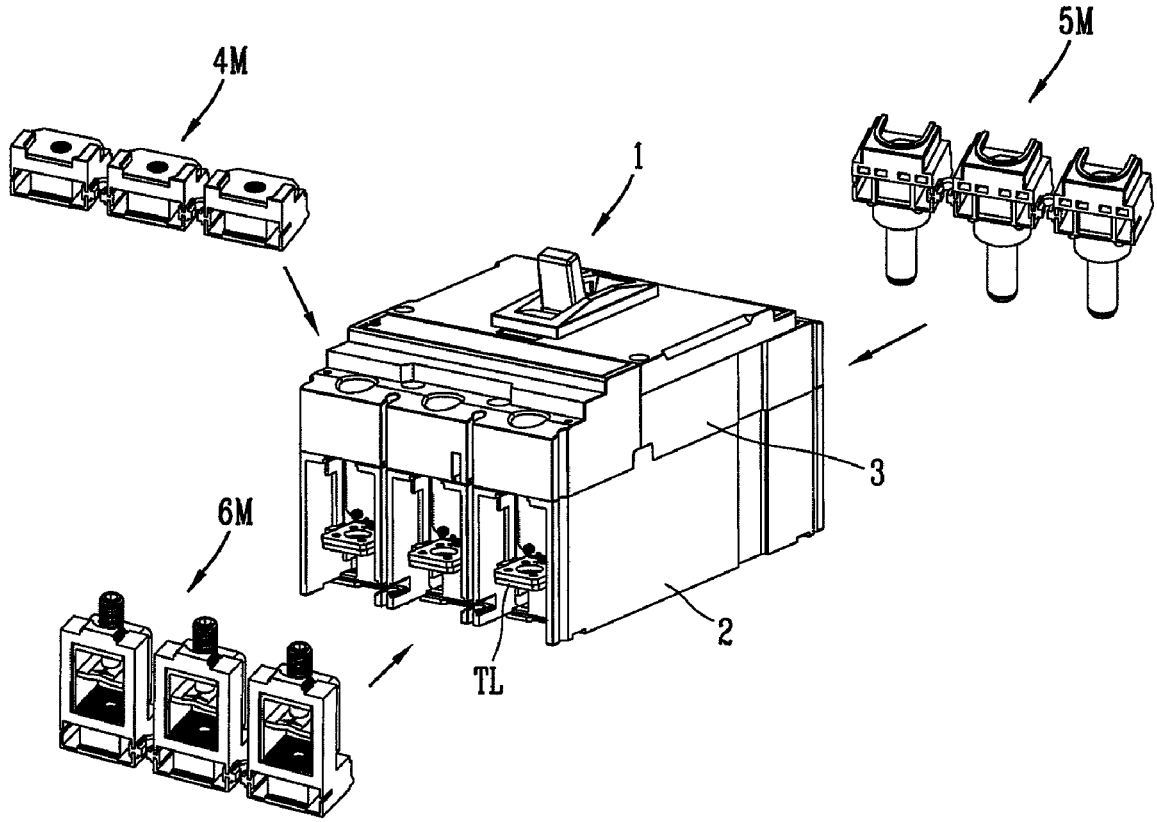
FIG. 1 is a perspective view illustrating various types of modular terminals for a molded case circuit breaker and an assembling of the modular terminals to the molded case circuit breaker.

FIG. 1 is a perspective view illustrating various types of modular terminals for a molded case circuit breaker and an assembling of the modular terminals to the molded case circuit breaker, explanation of which will be given as follows.

Various types of modular terminals of a molded case circuit breaker 1 according to the present invention may include a standard type terminal module 4M, a plug-in type terminal module 5M and a box type terminal module 6M.

The molded case circuit breaker 1 may roughly include a lower case 2 having major components thereof, such as a switching mechanism, a trip mechanism, an arc extinguishing mechanism, and the like, and an upper cover 3 covering an opened portion of an upper side of the lower case 2.

3 or 4 terminal portions TL of fixed contacts electrically connected to inner fixed contactors (not shown) are disposed at both end portions of the lower case 2 in its length direction (i.e., a power source side wire connecting portion and a electric load side wire connecting portion). Here, in case of a molded case circuit breaker for 3 poles (phases) R, S and T, 3 terminal portions TL of the fixed contactors are provided, while in case of a molded case circuit breaker for 4 poles (phases) of R, S, T and N, 4 terminal portions TL of the fixed contactors are provided.

The standard type terminal module 4M, the plug-in type terminal module 5M and the box type terminal module 6M according to the present invention may selectively be mounted to the terminal portion of the molded case circuit breaker 1 as shown in FIG. 1.

Here, since the modular terminal of the present invention is modularized, unlike in the related art of mounting one by one a terminal assembly according to each phase, three different types of terminal modules are selected as power source side terminal modules or electric load side terminal modules thus to be all simply mounted.

Figure 2:
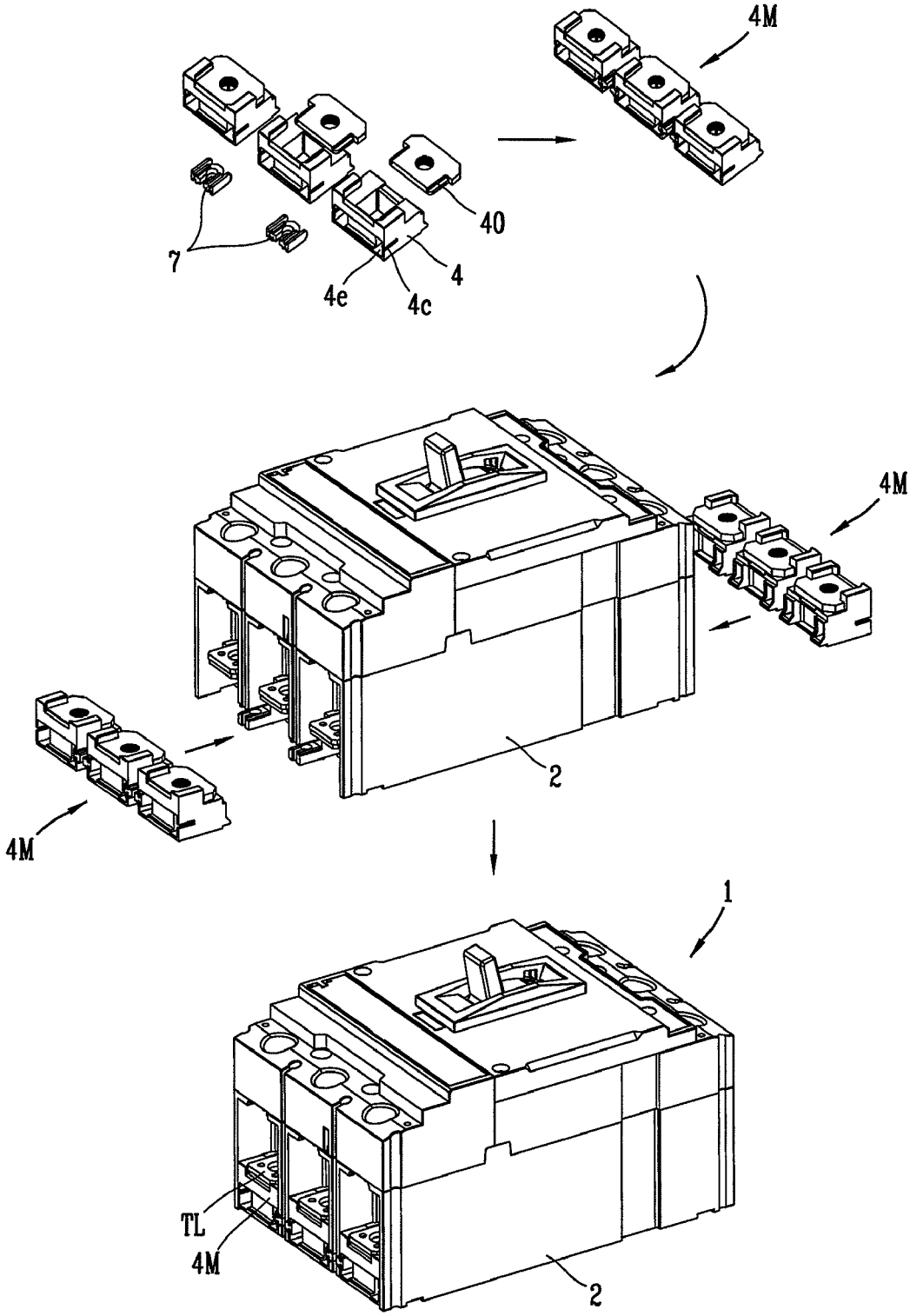
FIG. 2 is a state view illustrating an operation of assembling a standard type terminal module and mounting the assembled standard type terminal module to a molded case circuit breaker according to the present invention.
Figure 3:
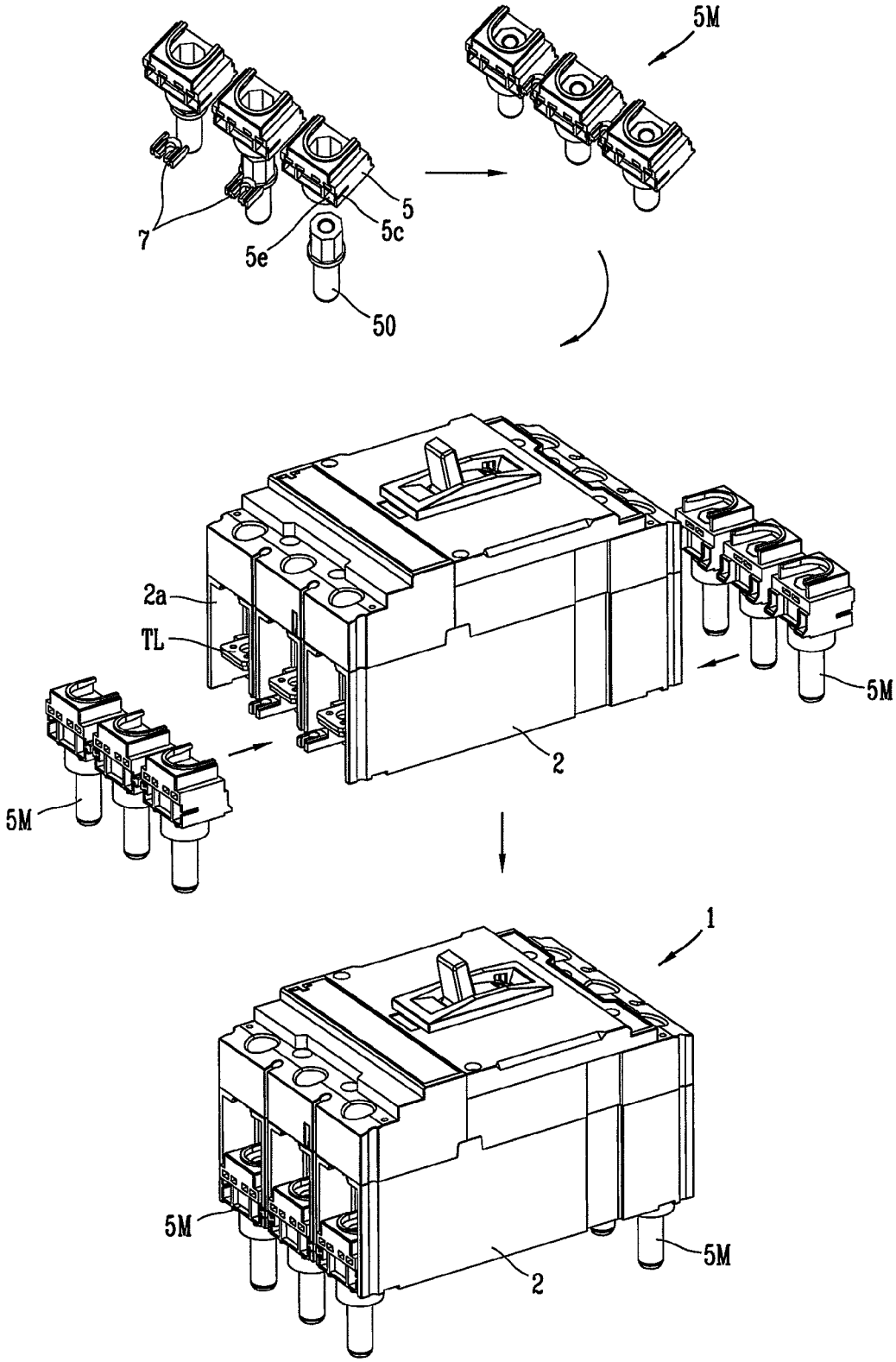
FIG. 3 is a state view illustrating an operation of assembling a plug-in type terminal module and mounting the assembled plug-in type terminal module to a molded case circuit breaker according to the present invention.
Figure 4:
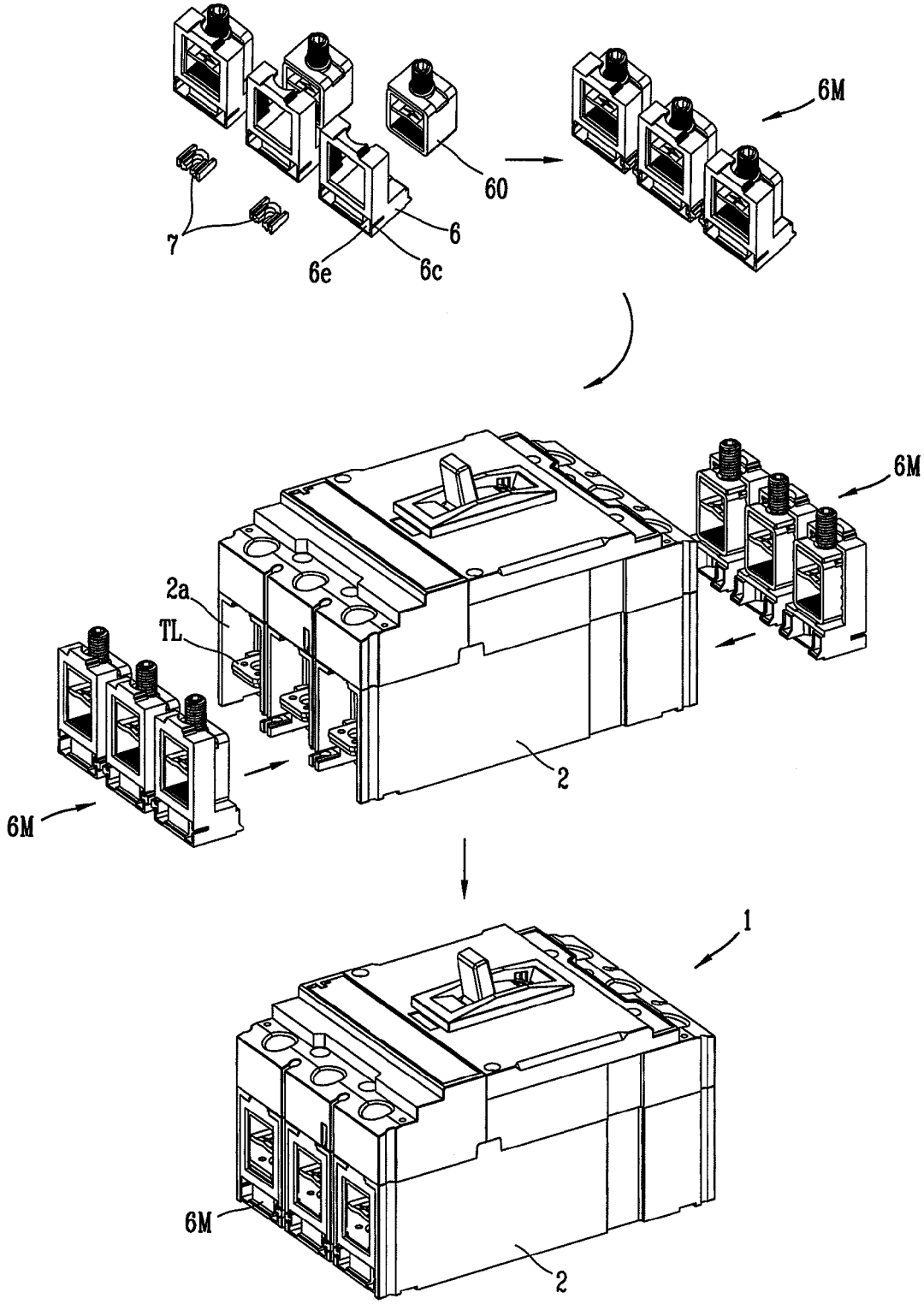
FIG. 4 is a state view illustrating an operation of assembling a box type terminal module and mounting the assembled box type terminal module to a molded case circuit breaker according to the present invention.

Each modular terminal according to the present invention, as shown in the left drawing at the top of FIGS. 2 to 4, may include a plurality of terminal bases 4, 5 and 6 provided by each phase, terminals 40, 50 and 60 detachably supported by each terminal base, and joint pieces 7 for coupling a pair of adjacent terminal bases to form a terminal module.

As shown in the left drawing at the top of FIGS. 2 to 4, the terminal bases 4, 5 and 6 respectively have joint piece insertion slot portions 4*c*, 5*c* and 6*c* for coupling the joint pieces 7 thereto.

Also, the terminal bases 4, 5 and 6 respectively have tubular passage portions 4*e*, 5*e* and 6*e* for providing discharge holes for arc gas near the joint piece insertion slot portions 4*c*, 5*c* and 6*c* and allowing an insertion of the joint pieces 7.

A detailed description of each terminal base will be given later.

A detailed structure of the joint piece 7 will be described with reference to FIG. 7 as follows.

The joint piece 7 may include channel portions 7*c*1, 7*c*2, 7*c*3 and 7*c*4 for connecting the joint piece 7 to the joint piece insertion slot portions 4*c*, 5*c* or 6*c* of each terminal base 4, 5 and 6.

Preferably, the joint piece 7 has four channel portions 7*c*1, 7*c*2, 7*c*3 and 7*c*4 at both upper and lower surfaces of both sides of its body portion 7*a*.

The channel portions 7*c*1, 7*c*2, 7*c*3 and 7*c*4 can be formed at both sides of the body portion 7*a* by protrusions 7*l*1 to 7*l*4 and 7*s*1 to 7*s*4 longitudinally protruded along a length direction of the body portion 7*a* and the upper and lower surface of the body portion 7*a*.

Figure 8:
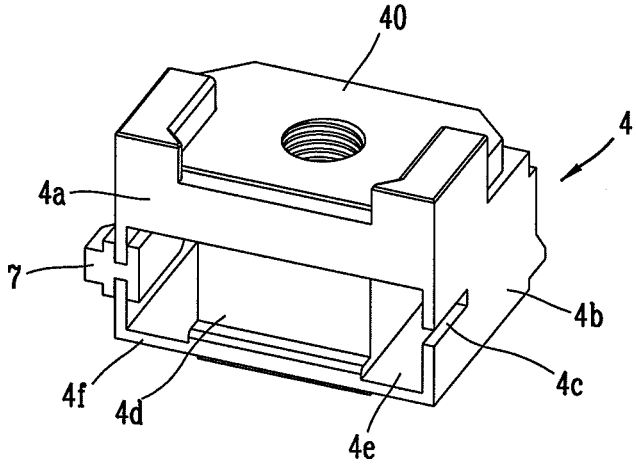
FIG. 8 is a rear side view of a standard type terminal base illustrating a construction of a portion to which a joint piece is coupled in a standard type terminal base according to the present invention.
Figure 9:
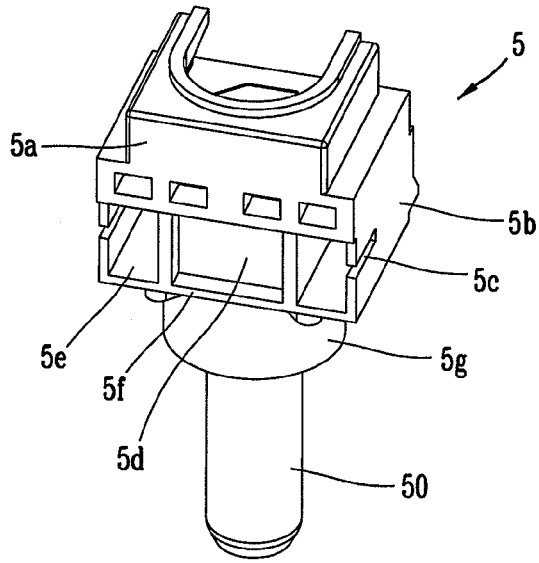
FIG. 9 is a rear side view of a plug-in type terminal base illustrating a construction of a portion to which a joint piece is coupled in a plug-in type terminal base according to the present invention.
Figure 10:
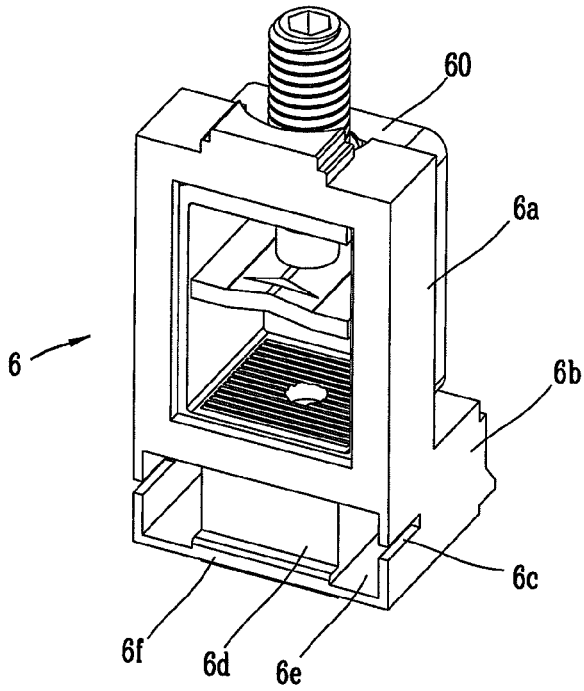
FIG. 10 is a rear side view of a box type terminal base illustrating a construction of a portion to which a joint piece is coupled in a box type terminal base according to the present invention.

The terminal base insertion protrusions 7*l*1 to 7*l*4 of the protrusions 7*l*1 to 7*l*4 and 7*s*1 to 7*s*4 correspond to portions to be inserted into the tubular passage portions 4*e*, 5*e* and 6*e* of each of the terminal bases 4, 5 and 6, as shown in FIGS. 8 to 10, for the modularization. Therefore, in order to firmly couple the adjacent terminal bases 4, 5 and 6 to each other, preferably, each of the terminal base insertion protrusions 7*l*1 to 7*l*4 has a length longer than that of each case insertion protrusion 7*s*1 to 7*s*4, and has a height d2 higher than the height d2 of each case insertion protrusion 7*s*1 to 7*s*4.

The terminal base insertion protrusions 7*l*1 to 7*l*4 are positioned to form outer wall surfaces at both sides of the body portion 7*a*, and the case insertion protrusions 7*s*1 to 7*s*4 are positioned to be inwardly adjacent to the terminal base insertion protrusions 7*l*1 to 7*l*4 at both sides of the body portion 7*a*.

Figure 5:
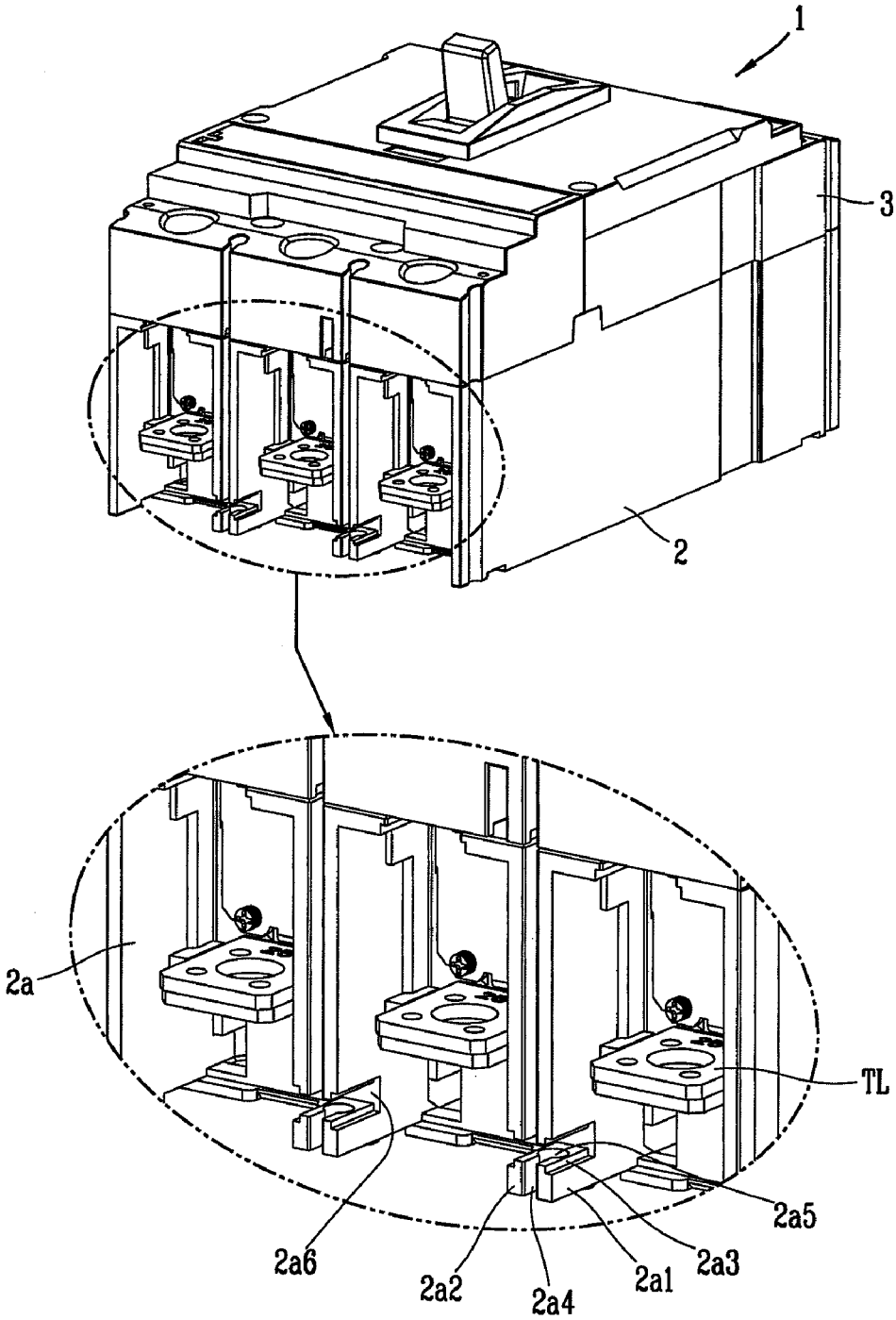
FIG. 5 is a perspective view illustrating a construction of a portion to which a joint piece is coupled in a case for a molded case circuit breaker according to the present invention, wherein a circle in FIG. 5 is a partially enlarged view.

The case insertion protrusions 7*s*1 to 7*s*4, as shown in FIG. 5, are inserted into a insulating partition wall 2*a* positioned at the terminal portion of the lower case 2, in more detail, into joint piece insertion slot portions 2*a*6 formed at a lower end portion of each insulating partition wall 2*a* according to each phase.

In more detail, the case insertion protrusions 7s1 to 7s4 are slidingly inserted onto rails 2a3 inside the joint piece insertion slot portions 2a6 to thusly be coupled thereto.

Figure 7:
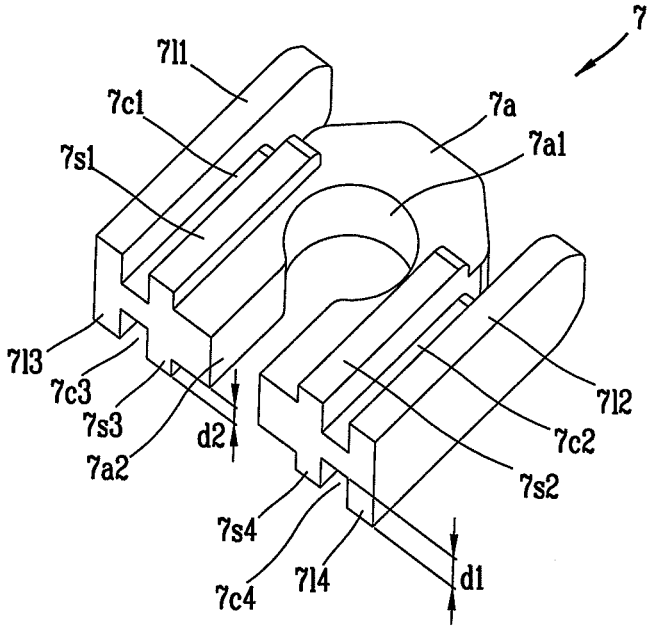
FIG. 7 is a perspective view illustrating a detailed construction of a joint piece according to the present invention.

Still referring to FIG. 7, the joint piece 7 may include one circular groove wall 7a1 inside the body portion 7a1 and a pair of channel walls 7a2 extended from an inlet of the circular groove wall 7a1 to face each other so that joint piece 7 can have an elastic force so as to maintain the connection between a pair of adjacent terminal bases 4, 5 and 6,.

Therefore, if the distance between the pair of channel walls 7a2 are increased or decreased when coupling the joint piece 7 to the terminal bases 4, 5, and 6 and the case, an elastic restoration force is generated to return to the original state. Accordingly, when the joint piece 7 is coupled to the terminal bases 4, 5, and 6 and the case, the connected state can firmly be maintained.

Detailed constructions of various types of terminal bases 4, 5 and 6 will be described with reference to FIGS. 8 to 10 as follows.

FIG. 8 is a rear side view of a standard type terminal base illustrating a construction of a portion to which the joint piece 7 is coupled in a standard type terminal base 4 according to the present invention, FIG. 9 is a rear side view of a plug-in type terminal base illustrating a construction of a portion to which the joint piece is coupled in a plug-in type terminal base according to the present invention, FIG. 10 is a rear side view of a box type terminal base illustrating a construction of a portion to which the joint piece is coupled in a box type terminal base according to the present invention.

First, the construction of a standard type terminal base according to the present invention will be described with reference to FIG. 8 as follows.

The standard type terminal base 4 according to the present invention may include an upper terminal accommodating unit 4a, a body portion 4d and a bottom plate 4f.

The upper terminal accommodating portion 4a is provided with guide channel portions (not shown) to accommodate the standard type terminal 40 on its upper surface. The upper terminal accommodating portion 4a and the bottom plate portion 4f are protruded to a lateral side of the body portion 4d thus to have a large area.

Both lateral walls of the upper terminal accommodating portion 4a and both lateral walls of the bottom plate portion 4f are integrally connected to each other to form lateral walls 4b. Joint piece insertion slot portions 4c are formed at the rear end portions of the both lateral walls 4b in a horizontal direction.

At two spaces between the both lateral walls 4b and the body portion 4d are formed tubular passage portions 4e in a horizontal direction to be adjacent to the corresponding joint piece insertion slot portions 4c. Accordingly, the tubular passage portions 4e can provide discharge holes of arc gas generated during the breaking of the molded case circuit breaker or a trip operation, and simultaneously can allow the insertion of the joint pieces (refer to the numeral 7 of FIG. 7).

By illustrating the joint piece 7 in FIG. 8, the connection method between the joint piece 7 and the terminal base 4 can be emphasized. Here, other portions of the joint piece 7 except for its contacted portion have not been illustrated.

The construction of a plug-in type terminal base according to the present invention will be described in detail with reference to FIG. 9 as follows.

As illustrated in FIG. 9, a plug-in type terminal base 5 according to the present invention may include an upper terminal accommodating portion 5a, a body portion 5d, a bottom plate portion 5f and a plug-in terminal insertion pipe portion 5g.

The upper terminal accommodating portion 5a provides a space for accommodating a terminal portion of a fixed contactor (refer to T of FIG. 1) on its upper surface.

Also, in the upper terminal accommodating portion 5a, the upper end of the plug-in terminal 50 and the terminal portion of the fixed contactor come in contact with each other to thus be electrically connected.

In addition, the upper end of the plug-in terminal 50 and the terminal portion of the fixed contactor can keep contacted with each other by being coupled to each other by a fixing screw (not shown) inside the upper terminal accommodating portion 5a.

The upper terminal accommodating portion 5a and the bottom plate portion 5f are extended from both lateral sides of the body portion 5d so as to have large areas.

Both lateral walls of the upper terminal accommodating portion 5a and both lateral walls of the bottom plate portion 5f are connected in monolithic form to each other to form lateral walls 5b. Joint piece insertion slot portions 5c are formed at the rear end portions of the both lateral walls 5b in a horizontal direction.

At two positions between the both lateral walls 5b and the body portion 4d are formed tubular passage portions 5e in a horizontal direction to be adjacent to the corresponding joint piece insertion slot portions 5c. Accordingly, the tubular passage portions 5e can provide discharge holes of arc gas generated during the breaking of the molded case circuit breaker or a trip operation, and simultaneously can allow the insertion of the joint pieces (refer to the numeral 7 in FIG. 7).

The plug-in terminal insertion pipe portion 5g is a tubular member extended downwardly from the bottom plate 5f. Its inner circumferential surface (not shown) is formed in a corresponding polygonal shape with a polygonal upper shape of the plug-in terminal 50 (refer to the shape of the numeral 50 in the left drawing at the top of FIG. 3).

The detailed construction of a box type terminal base according to the present invention will be described with reference to FIG. 10.

A box type terminal base 6 according to the present invention may include a window-shaped upper frame 6a, a body portion 6d and a bottom plate portion 6f.

The window-shaped upper frame 6a has a window-shaped perpendicular opening to allow the insertion of the external wire from the power source or electric load side therethrough.

A horizontal surface portion is formed on a lower end portion of the window-shaped upper frame 6a such that the box type terminal 60 (refer to the left drawing on the top of FIG. 4) is mounted thereon. The window-shaped upper frame 6a and the bottom plate portion 6f are extended from both lateral surfaces of the body portion 6d so as to have large areas.

The horizontal surface portion of the lower end of the window-shaped upper frame 6a and both lateral walls of the bottom plate 6f are integrally connected to each other to form lateral walls 6b. Joint piece insertion slot portions 6c are formed at the rear end portions of the both lateral walls 6b in a horizontal direction.

At two spaces between the both lateral walls 6b and the body portion 6d are formed tubular passage portions 6e in a horizontal direction to be adjacent to the corresponding joint piece insertion slot portions 6c. Accordingly, the tubular passage portions 6e can provide discharge holes of arc gas generated during the breaking of the molded case circuit breaker or a trip operation, and simultaneously can allow the insertion of the joint pieces (refer to the numeral 7 in FIG. 7).

Constructions of a case according to the present invention and a molded case circuit breaker having the case according to the present invention will be described with reference to FIGS. 5 and 6 as follows.

Figure 6:
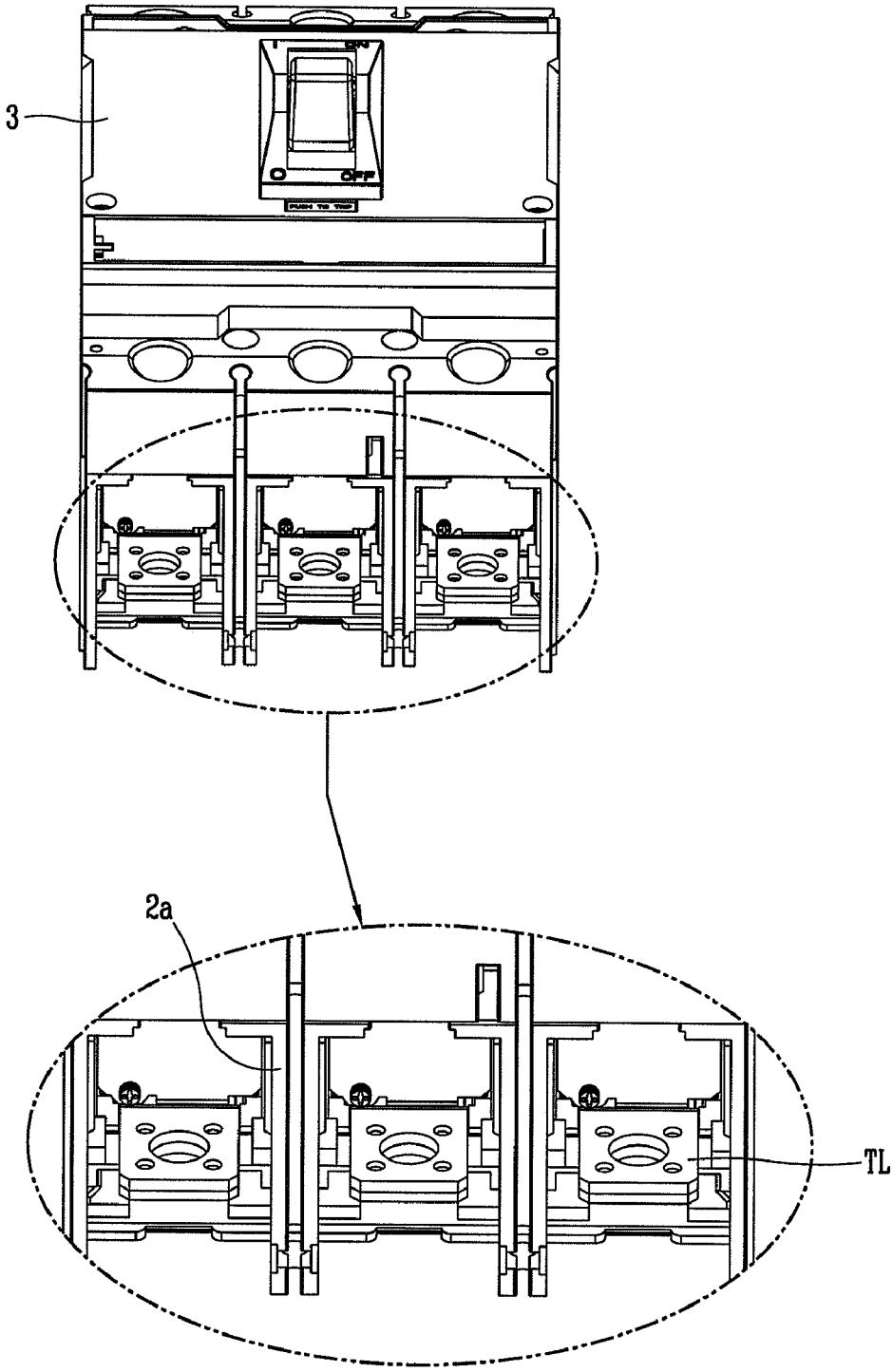
FIG. 6 is a front side view, shown from slightly upside, illustrating a construction of a portion to which a joint piece is coupled in a case for a molded case circuit breaker according to the present invention, wherein a circle in FIG. 6 is a partially enlarged view.

FIG. 5 is a perspective view illustrating a construction of a portion to which a joint piece is coupled in a case for a molded case circuit breaker according to the present invention, wherein a circle in FIG. 5 is a partially enlarged view, and FIG. 6 is a front side view, shown from slightly upside, illustrating a construction of a portion to which a joint piece is coupled in the case for a molded case circuit breaker according to the present invention, wherein a circle in FIG. 6 is a partially enlarged view.

As illustrated in FIGS. 5 and 6, in the molded case circuit breaker 1 according to the present invention, the case may include a lower case 2 and an upper cover 3. The lower case 2 may include a plurality of insulating partition walls 2*a* for electrically insulating terminal portions according to each phase (pole).

A pair of inner insulating partition walls except for both outer insulating partition walls among all the insulating partition walls 2*a* are interposed between a pair of terminal portions TL of the fixed contactors adjacent to each other.

In more detail, the pair of inner insulating partition walls 2*a* are provided to be adjacent to each other with a predetermined interval, namely, with an interval concerning the intervals between the case insertion protrusions 7*s*1 to 7*s*4 (refer to FIG. 7) of the joint piece 7 (i.e., the interval between 7*s*1 and 7*s*2 and the interval between 7*s*3 and 7*s*4).

At the lower end portion of the insulating partition wall 2*a* is provided a joint piece insertion slot portion 2*a*6 in which the joint piece 7 is inserted so as to be connected to the insulating partition wall 2*a*.

Rails 2*a*3 are disposed at upper and lower sides of each of the pair of insulating partition walls 2*a* having the joint piece insertion slot portions 2*a*6 formed thereat. A pair of rails 2*a*3 in all (i.e., two rails) are respectively formed at the lower end portions of the pair of insulating partition walls 2*a* adjacent to each other (i.e. totally 4 rails), thus to guide and support the case insertion protrusions 7*s*1 to 7*s*4 (in FIG. 7) of the joint piece 7.

Unexplained reference numerals 2*a*1 and 2*a*2 denote lower rail walls (i.e., right and left walls) for forming a pair of lower rails 2*a*3.

Upper rail walls (i.e., right and left walls) forming a pair of upper rails 2*a*3 may also exist, and upwardly extended walls of the pair of the upper rails 2*a*3 correspond thereto. However, no reference numerals are not given thereto.

Channel walls 2*a*4 and a circular groove wall 2*a*5 having the same structure to that of the joint piece 7 are formed both in the lower rail walls 2*a*1 and 2*a*2 and in the upper rail walls. Accordingly, when the channel walls 2*a*4 and the circular groove wall 2*a*5 are connected to the joint piece 7, an elastic restoration force is generated to firmly maintain the connection therebetween.

That is, by sliding the case insertion protrusions 7*s*1 to 7*s*4 of the joint piece 7 to the rails 2*a*3, even if the interval between the lower rail walls 2*a*1 and 2*a*2 and the interval between the upper rail walls are decreased, both channel walls 2*a*4 are returned to their original states by an elastic structure of the channel walls 2*a*4 and the circular groove wall 2*a*5. Accordingly, the joint piece 7 can firmly be connected to the lower rail walls 2*a*1 and 2*a*2 of the insulating partition walls 2*a* and the upper rail walls thereof.

Explanation will be given of the constructions of modular terminals according to each type and a molded case circuit breaker having the same according to the present invention, an assembling of the modular terminal, and an operation of mounting of the assembled modular terminal to the molded case circuit breaker as follows.

FIG. 2 is a state view illustrating an operation of assembling a standard type terminal module and mounting the assembled standard type terminal module to a molded case circuit breaker according to the present invention, FIG. 3 is a state view illustrating an operation of assembling a plug-in type terminal module and mounting the assembled plug-in type terminal module to a molded case circuit breaker according to the present invention, and FIG. 4 is a state view illustrating an operation of assembling a box type terminal module and mounting the assembled box type terminal module to a molded case circuit breaker according to the present invention.

First, an operation process of assembling a standard type terminal module to mount it to the molded case circuit breaker according to the present invention will be described with reference to FIG. 2.

As illustrated in the left drawing at the top of FIG. 2, a standard type terminal 40 is inserted into the upper side of the standard type terminal base 4, thereby obtaining an intermediate assembly.

Here, in case of a 3-phases (3-poles) molded case circuit breaker, six of the standard type terminals 40 are inserted into the upper sides of six standard type terminal bases 4 (i.e., 3 into the power source side and 3 into the electric load side).

In case of a 4-phase molded case circuit breaker, eight of the standard type terminals 40 are inserted into eight standard type terminal bases 4 (i.e., 4 into the power source side and 4 into the electric load side).

Three of the intermediate assemblies obtained by assembling the standard type terminal base and the standard type terminal 40 to each other are prepared for each of the power source side and the electric load side. The middle intermediate assembly is joined to the other intermediate assemblies at its both lateral sides by inserting the joint pieces 7 into the joint piece insertion slot portions 4*c* and the tubular passage portions 4*e* of the other intermediate assemblies, thereby obtaining one standard type terminal module 4M according to the present invention.

Two of the standard type terminal modules 4M are assembled for the power source side terminal and the electric load side terminal to be inserted into both terminal portions of the molded case circuit breaker 1 as shown in the middle of FIG. 2, so as to completely assemble the molded case circuit breaker 1 according to the present invention. Here, the standard type terminals 40 of the standard type terminal module 4M come in contact with the terminal portions TL of the fixed contactors of the molded case circuit breaker 1 to be electrically conducted.

Therefore, the joint pieces 7, which connect a pair of adjacent standard type terminal bases 4 for forming a terminal module, allow the connection of a plurality of standard type terminal bases 4 provided by each phase and the standard type terminals 40 detachably supported by each of the standard type terminal bases 4. That is, the plurality of standard type terminal bases 4 having the standard type terminals 40 mounted thereat are connected to each other by the joint pieces 7 so as to construct the standard type terminal module 4M. Then, the molded case circuit breaker 1 having the modular terminal according to the present invention with the case (i.e., the lower case) connected to the standard type terminal module 4M by the joint pieces 7 can be assembled.

Thus, it is obvious that the completely assembled molded case circuit breaker 1 with the modular terminal according to the present invention has the construction of the case (i.e., the lower case 2) described with reference to FIGS. 5 and 6, the construction of the joint piece 7 described with reference to FIG. 7 and the construction of the standard type terminal base 4 described with reference to FIG. 8.

An operation of assembling a plug-in type terminal module and mounting the assembled plug-in type terminal module so as to obtain a molded case circuit breaker according to the present invention will be described with reference to FIG. 3.

As illustrated in the left drawing on the top of FIG. 3, a plug-in type terminal 50 is inserted into a plug-in type terminal base 5, thereby obtaining an intermediate assembly. Here, in case of a 3-phases (3-poles) molded case circuit breaker, six of the plug-in type terminals 50 are inserted into the upper sides of six plug-in type terminal bases 5 (i.e., 3 into the power source side and 3 into the electric load side). In case of a 4-phase molded case circuit breaker, eight of the plug-in type terminals 50 are inserted into eight plug-in type terminal bases 5 (i.e., 4 into the power source side and 4 into the electric load side).

Three of the intermediate assemblies obtained by assembling the plug-in type terminal base 5 and the plug-in type terminal 40 are prepared for each of the power source side and the electric load side. The middle intermediate assembly is joined to the other intermediate assemblies at its both lateral sides by inserting the joint pieces 7 into the joint piece insertion slot portions 5*c* and the tubular passage portions 5*e* of the other intermediate assemblies, thereby obtaining one plug-in type terminal module 5M according to the present invention as shown in the right drawing on the top of FIG. 3.

Two of the plug-in type terminal modules 5M are assembled for the power source side terminal and the electric load side terminal to be inserted into both terminal portions of the molded case circuit breaker 1 as shown in the middle of FIG. 3, so as to completely assemble the molded case circuit breaker 1 according to the present invention as shown in the bottom of FIG. 3. Here, the plug-in type terminals 50 of the plug-in type terminal module 5M come in contact with the terminal portions TL of the fixed contactors of the molded case circuit breaker 1 to be electrically conducted.

Therefore, the joint pieces 7, which connect a pair of adjacent plug-in type terminal bases 5 for forming a terminal module, allow the connection of a plurality of plug-in type terminal bases 5 provided by each phase and the plug-in type terminals 50 detachably supported by each of the plug-in type terminal bases 5. That is, the plurality of plug-in type terminal bases 5 having the plug-in type terminals 50 mounted thereat are connected to each other by the joint pieces 7 to construct the plug-in type terminal module 5M. Then, the molded case circuit breaker 1 with the modular terminal according to the present invention having the case (i.e., the lower case) connected to the plug-in type terminal module 5M by the joint pieces 7 can be assembled.

Thus, it is obvious that the completely assembled molded case circuit breaker 1 with the modular terminal according to the present invention has the construction of the case (i.e., the lower case 2) described with reference to FIGS. 5 and 6, the construction of the joint piece 7 described with reference to FIG. 7 and the construction of the plug-in type terminal base 5 described with reference to FIG. 9.

Now, an operation of assembling a box type terminal module and mounting the assembled box type terminal module so as to obtain a molded case circuit breaker according to the present invention will be described with reference to FIG. 4.

As illustrated in the left drawing on the top of FIG. 4, a box type terminal 60 is inserted into a box type terminal base 6, thereby obtaining an intermediate assembly. Here, in case of a 3-phases (3-poles) molded case circuit breaker, six of the box type terminals 60 are inserted into the upper sides of six box type terminal bases 6 (i.e., 3 into the power source side and 3 into the electric load side). In case of a 4-phase molded case circuit breaker, eight of the plug-in type terminals 50 are inserted into eight box type terminal bases 6 (i.e., 4 into the power source side and 4 into the electric load side).

Three of the intermediate assemblies obtained by assembling the box type terminal base 6 and the box type terminal 60 are prepared for each of the power source side and the electric load side. The middle intermediate assembly is joined to the other intermediate assemblies at its both lateral sides by inserting the joint pieces 7 into the joint piece insertion slot portions 6*c* and the tubular passage portions 6*e* of the other intermediate assemblies, thereby obtaining one box type terminal module 6M according to the present invention as shown in the right drawing on the top of FIG. 4.

Two of the box type terminal modules 6M are assembled for the power source side terminal and the electric load side terminal to be inserted into both terminal portions of the molded case circuit breaker 1 as shown in the middle of FIG. 4, so as to completely assemble the molded case circuit breaker 1 according to the present invention as shown in the bottom of FIG. 4. Here, the bottoms of the box type terminals 60 of the box type terminal module 6M come in contact with the terminal portions TL of the fixed contactors of the molded case circuit breaker 1 to be electrically conducted.

Therefore, the joint pieces 7, which connect a pair of adjacent box type terminal bases 6 for forming a terminal module, allow the connection of a plurality of box type terminal bases 6 provided by each phase and the box type terminals 60 detachably supported by each of the box type terminal bases 6. That is, the plurality of box type terminal bases 6 having the box type terminals 60 mounted thereat are connected to each other by the joint pieces 7 to construct the box type terminal module 6M. Then, the molded case circuit breaker 1 with the modular terminal according to the present invention having the case (i.e., the lower case) connected to the box type terminal module 6M by the joint pieces 7 can be assembled.

Thus, it is obvious that the completely assembled molded case circuit breaker 1 with the modular terminal according to the present invention mounted thereat has the construction of the case (i.e., the lower case 2) described with reference to FIGS. 5 and 6, the construction of the joint piece 7 described with reference to FIG. 7 and the construction of the box type terminal base 6 described with reference to FIG. 10.

Various combinations of modular terminals can be mounted to the case for the molded case circuit breaker according to the present invention, which will be described with reference to FIGS. 11 and 12 as follows.

Figure 11:
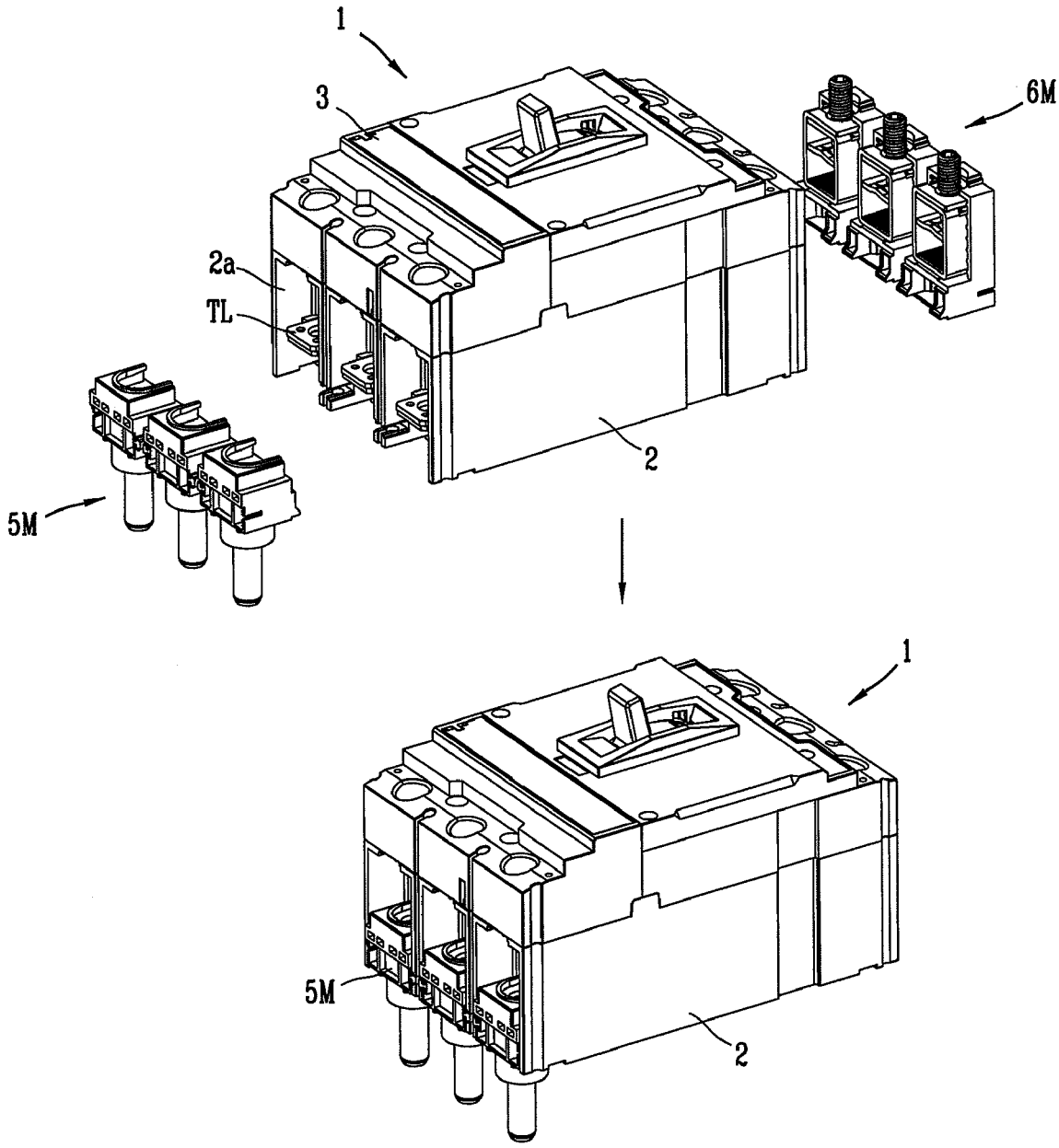
FIG. 11 is a view illustrating that various types of modular terminals for a molded case circuit breaker can be assembled according to the types of terminals according to the present invention, namely, a perspective view illustrating an exemplary construction of a molded case circuit breaker in which a plug-in type terminal module is mounted to a power source side terminal and a box type terminal module is mounted to a electric load side terminal according to the present invention.

FIG. 11 is a view illustrating that various combinations of modular terminals for a molded case circuit breaker can be assembled onto the case of the molded case circuit breaker according to the present invention, namely, a perspective view illustrating an exemplary construction of a molded case circuit breaker in which a plug-in type terminal module is mounted to a power source side terminal and a box type terminal module is mounted to a electric load side terminal according to the present invention.

As illustrated in FIG. 11, the plug-in type terminal module 5M is mounted to the power source side terminal (i.e., the left terminal portion of FIG. 11) and the box type terminal module 6M is mounted to the electric load side terminal (i.e., the right terminal portion of FIG. 11). Accordingly, as shown in the lower drawing of FIG. 11, a molded case circuit breaker 1 can be configured such that the left power source side terminal should be connected to a plug-in base (not shown) (e.g., a type of terminal base having a connection hole to which the plug-in terminal is inserted) and the right electric load side terminal should be connected to a electric load side wire having a "U" or "ring" type terminal.

Figure 12:
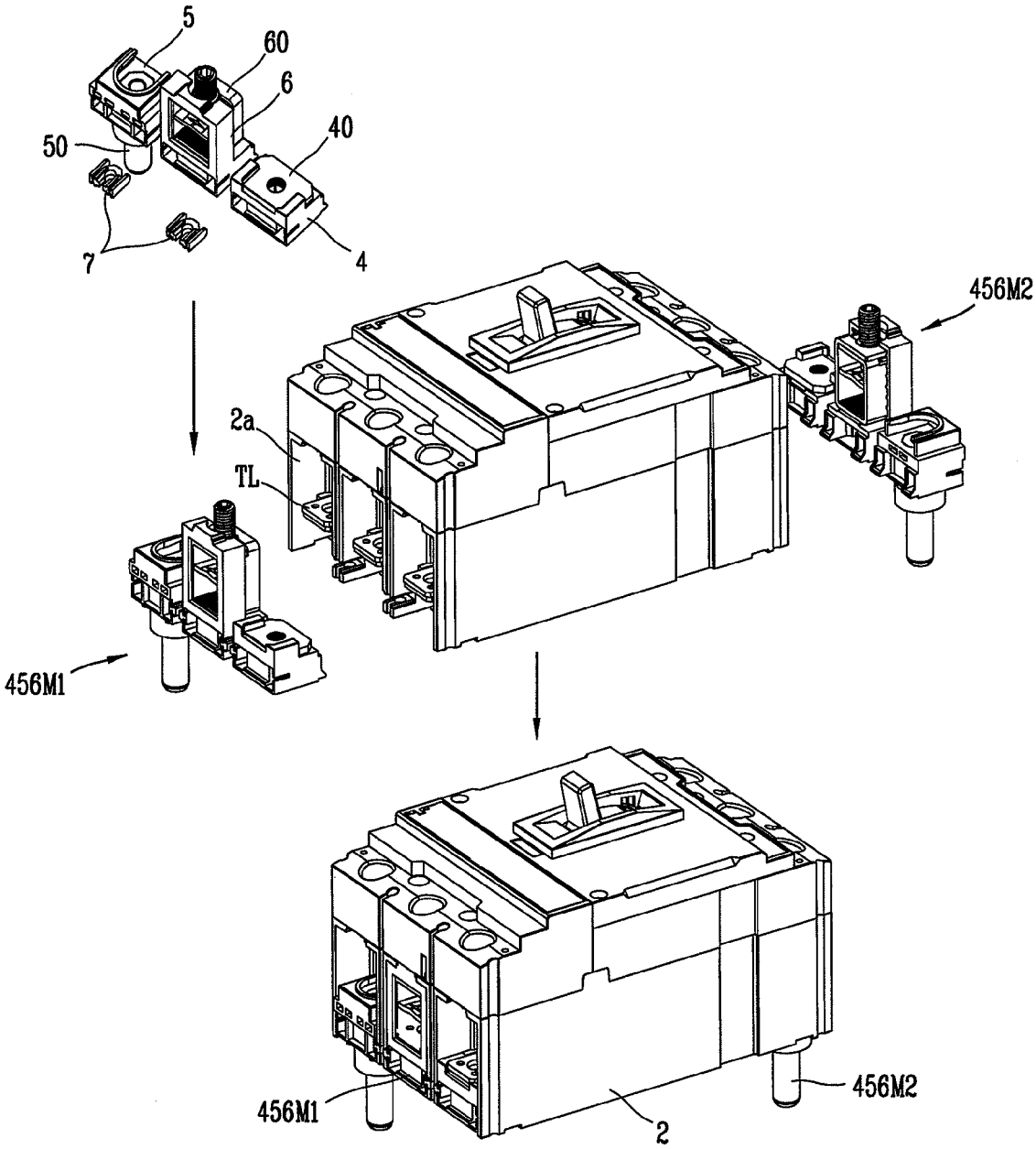
FIG. 12 is a view illustrating that various types of modular terminals for a molded case circuit can be assembled according to the types of terminals according to the present invention, namely, a perspective view illustrating an exemplary construction of a molded case circuit breaker in which terminal modules each obtained by joining a standard type terminal assembly, a plug-in type terminal assembly and a box type terminal assembly are respectively mounted to a power source side terminal and to a electric load side terminal according to the present invention.

FIG. 12 is a view illustrating that various combinations of modular terminals for a molded case circuit can be assembled according to the present invention, namely, a perspective view illustrating an exemplary construction of a molded case circuit breaker in which terminal modules each obtained by joining a standard type terminal assembly, a plug-in type terminal assembly and a box type terminal assembly are respectively mounted to a power source side terminal and to a electric load side terminal according to the present invention.

As shown at the top of FIG. 12, an intermediate assembly in which the standard type terminal 40 is assembled to the standard type terminal base 4, an intermediate assembly in which the box type terminal 60 is assembled to the box type terminal base 6 and an intermediate assembly in which the plug-in type terminal 50 is assembled to the plug-in type terminal base 50 are joined together by the joint pieces 7 so as to be modularized, thereby configuring the joined module 456M1 and 456M2 as shown in the middle of FIG. 12.

Therefore, as shown in the middle of FIG. 12, the joined modules 456M1 and 456M2 are inserted into the power source side terminal and the electric load side terminal of the molded case circuit breaker 1, respectively. Accordingly, as shown in the bottom of FIG. 12, the molded case circuit breaker having the joined modules 456M1 456M2 can be configured.

As described above, by providing the modular terminal for the molded case circuit breaker and the molded case circuit breaker having the modular terminal according to the present invention, a plurality of terminal assemblies can be modularized and thereby the terminal module can be easily assembled to the molded case circuit breaker, so as to facilitate the installation of the terminal portion and simplify the replacement operation thereof.

Also, the modular terminal for the molded case circuit according to the present invention can be modularized, thus to prevent the loss of the terminal. Accordingly, manufacturers can easily manage the stock of the terminals and easily treat them during the delivery thereof. In addition, the modular terminal can be supplied as a optional component, which makes users to effectively replace terminals with their desired ones.

In addition, by providing the modular terminal for the molded case circuit breaker and the molded case circuit breaker having the modular terminal according to the present invention, it is possible to obtain the modular terminal for the molded case circuit by joining various types of terminals to one terminal module and also to obtain the molded case circuit breaker having the modular terminal, such that the modular terminal and the molded case circuit breaker is having the same can be flexibly obtained in correspondence to the connection conditions of the terminal portions.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A molded case circuit breaker with a modular terminal, comprising:

a plurality of terminal bases each of which is provided for each phase;

a terminal which is detachably supported at each terminal base;

a joint piece which connects a pair of the terminal bases adjacent to each other to form a terminal module, wherein the plurality of terminal bases having the terminals mounted thereat are connected to each other so as to form the terminal module; and a case connected to the terminal module by the joint piece, wherein each terminal base comprises a joint piece insertion slot portion into which the joint piece is inserted.

2. The circuit breaker of claim 1, wherein the terminal base further comprises tubular passages by which a discharge hole of arc gas close to the joint piece insertion slot portion is provided and the insertion of the joint piece is available.

3. The circuit breaker of claim 1, wherein the joint piece comprises channel portion by which the joint piece is inserted into the joint piece insertion slot portion.

4. The circuit breaker of claim 1, wherein the joint piece comprises a circular groove wall and a pair of channel walls extending from an inlet of the circular groove wall so that the joint piece can have an elastic force to maintain the connection between a pair of adjacent terminal bases.

5. The circuit breaker of claim 1, wherein the joint piece comprises:

a body portion including a circular groove wall and a pair of channel walls extending from an inlet of the circular groove wall so that the body portion can have an elastic force to maintain the connection between a pair of adjacent terminal bases; and channel portions formed at upper and lower portions of both sides of the body portion to connect a pair of adjacent terminal bases.

6. The circuit breaker of claim 1, wherein the case comprises:

a circular groove wall and a pair of channel walls extending from an inlet of the circular groove wall so that the case can have an elastic force to maintain the connection with the joint piece.

* * * * *